US007032259B1

(12) United States Patent
Kilion

(10) Patent No.: US 7,032,259 B1
(45) Date of Patent: Apr. 25, 2006

(54) COLLAPSIBLE INFANT TUB

(76) Inventor: Elisheva Kilion, 18 Greenwich Ct., Holbrook, NY (US) 11741

( * ) Notice: Subject to any disclaimer, the term of this patent is extended or adjusted under 35 U.S.C. 154(b) by 198 days.

(21) Appl. No.: 10/803,224

(22) Filed: Mar. 18, 2004

(51) Int. Cl.
*A47K 3/024* (2006.01)

(52) U.S. Cl. ..... 4/572.1; 4/594; 4/645; 248/150; 220/629

(58) Field of Classification Search ..... 4/445, 4/446, 553, 554, 572.1, 584, 594, 643, 644, 4/645, 659; 248/146, 150; 220/629
See application file for complete search history.

(56) References Cited

U.S. PATENT DOCUMENTS

| | | | | |
|---|---|---|---|---|
| 418,588 | A | 12/1889 | Prinz | |
| 1,109,418 | A * | 9/1914 | Hines | 220/629 X |
| 1,144,261 | A | 6/1915 | Tanaka | |
| 1,342,807 | A * | 6/1920 | Harrington | 248/146 X |
| 1,855,864 | A * | 4/1932 | Mjaaland et al. | 4/644 |
| 1,883,660 | A | 10/1932 | Feldman | |
| 2,765,475 | A | 10/1956 | Nolan | |
| 2,804,989 | A * | 9/1957 | Mango | 220/629 |
| 3,967,333 | A | 7/1976 | Boyd | |
| 4,146,938 | A | 4/1979 | Shakas | |
| 5,092,001 | A | 3/1992 | Ross et al. | |
| 5,297,300 | A | 3/1994 | Sheu | |
| 5,491,850 | A | 2/1996 | Kiester | |
| 6,776,379 | B1 * | 8/2004 | Sherer et al. | 248/150 |

* cited by examiner

*Primary Examiner*—Robert M. Fetsuga

(57) ABSTRACT

An apparatus for bathing infants includes a tub section having a recessed portion for supporting bathing accessories, a drain spout provided with a ball valve for dispensing and retaining water within the tub, a plurality of support members secured to the bottom surface, and a plurality of leg members positioned through the support members for maintaining the tub section at a stable position during operating conditions. Such leg members may be folded and extended and include a female portion and a male portion, which are telescopically engageable with one another. The present invention further includes a portable tray with a lip portion that fits on the outer edge of the tub section. Such a portable tray may be used for supporting bathing accessories.

15 Claims, 4 Drawing Sheets

COLLAPSIBLE INFANT TUB

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an infant tub and, more particularly, to a collapsible infant tub that may be raised or lowered for convenience.

2. Prior Art

The bathing of an infant child is a task but is usually one that is enjoyed by the infant as well as the person bathing the child, usually the child's parent. Infant children enjoy the feel and texture of the bath water as well as playing in the water. As a result, the bath water can be expected to splash from within the infant bathing apparatus to the surrounding area wherever the child is being bathed. Accordingly, the most convenient bathing device for a child is that of a kitchen sink, wherein some sort of plastic bathtub is utilized.

These plastic bathtubs may take on two forms, one of which is a plastic container that simply fits within the sink where the child is being bathed. The other sink type of plastic bathtubs are adapted to fit the frame of the sink so that the child and the water will be oriented in a particular direction usually semi-sitting while being bathed.

The kitchen sink type of child bathing apparatus is not always conveniently used in a kitchen sink. The normal schedule of everyday matters may dictate that the kitchen sink be utilized for other purposes at a time for the child's bath. Then, of course, the child must be bathed in a bathtub in a bathroom facility. In these instances the plain plastic tub or the one adapted to fit the kitchen sink is usually not suitable for use within a bathtub.

Furthermore, it is very inconvenient for the person bathing the child to have to kneel by the bathtub and extend his upper body and arms into the bathtub and within the child bathing device therein in order to bathe the child. This latter aspect seriously detracts from the enjoyment experienced by the parent and the baby during his bath. Because a baby is very tender, the mother or nurse must carefully catch the baby with one hand and then wash the baby with the other hand. Bathing or washing an infant child in a bathtub is difficult because there is the possibility that the infant will break loose from the mother's grasp and strike his or her head on the hard bathtub surface, with consequent possibility of injury.

Accordingly, a need remains for a tub made especially for infants that allows caregivers to more comfortably bathe infants and overcome the above-noted shortcomings.

BRIEF SUMMARY OF THE INVENTION

In view of the foregoing background, it is therefore an object of the present invention to provide a collapsible infant tub. These and other objects, features, and advantages of the invention are provided by an apparatus for bathing infants therein and including a tub section having a centrally disposed longitudinal axis and defining a cavity for supporting an infant therein during operating conditions. The tub section includes a substantially smooth bottom surface and an outer edge portion integral therewith and extending upwardly therefrom about a perimeter of the bottom surface. The outer edge portion of the tub section further has a recessed portion formed therein and subjacent to the drain spout. Such a recessed portion supports bathing accessories therein such as washcloths, soap bars and the like, for example.

The tub section further includes a drain spout in fluid communication with the cavity and extending outwardly and downwardly from the bottom surface. The drain spout includes a mechanism for dispensing and retaining water within the cavity respectively. The dispensing and retaining mechanism preferably includes a ball valve operably positioned within the drain spout that is selectively movable between open and closed positions.

The tub section further includes a plurality of hollow support members traversing the axis that are secured to the bottom surface and extending downwardly therefrom. Advantageously, the tub section has a plurality of leg members that are positioned through the plurality of support members respectively for maintaining the tub section at a substantially stable position during operating conditions. Such a plurality of leg members have opposed end portions engageable with a ground surface and are substantially equally offset from the axis. The opposed end portions have substantially planar bottom surfaces, which may be formed from rubber material for assisting to maintain the apparatus at a substantially stable position, as well-known to a person of ordinary skill in the art.

The plurality of leg members are pivotal about the plurality of support members, between folded and extended positions respectively. Each of the leg members includes a plurality of female portions having a plurality of apertures formed therein and spaced along a generally vertical plane. The plurality of leg members also include a plurality of male portions telescopically engageable with the plurality of female portions. Such a plurality of male portions each include a spring-operable pin extending outwardly therefrom that is removably positionable into select ones of the plurality of apertures so that a height of the apparatus may be advantageously adjusted as desired by a user.

The present invention may further include a portable tray having a lip portion integral therewith for removably engaging the outer edge portion of the tub section. Such a portable tray may be used for supporting bathing accessories therein and is selectively slidable along a perimeter of the tub section.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
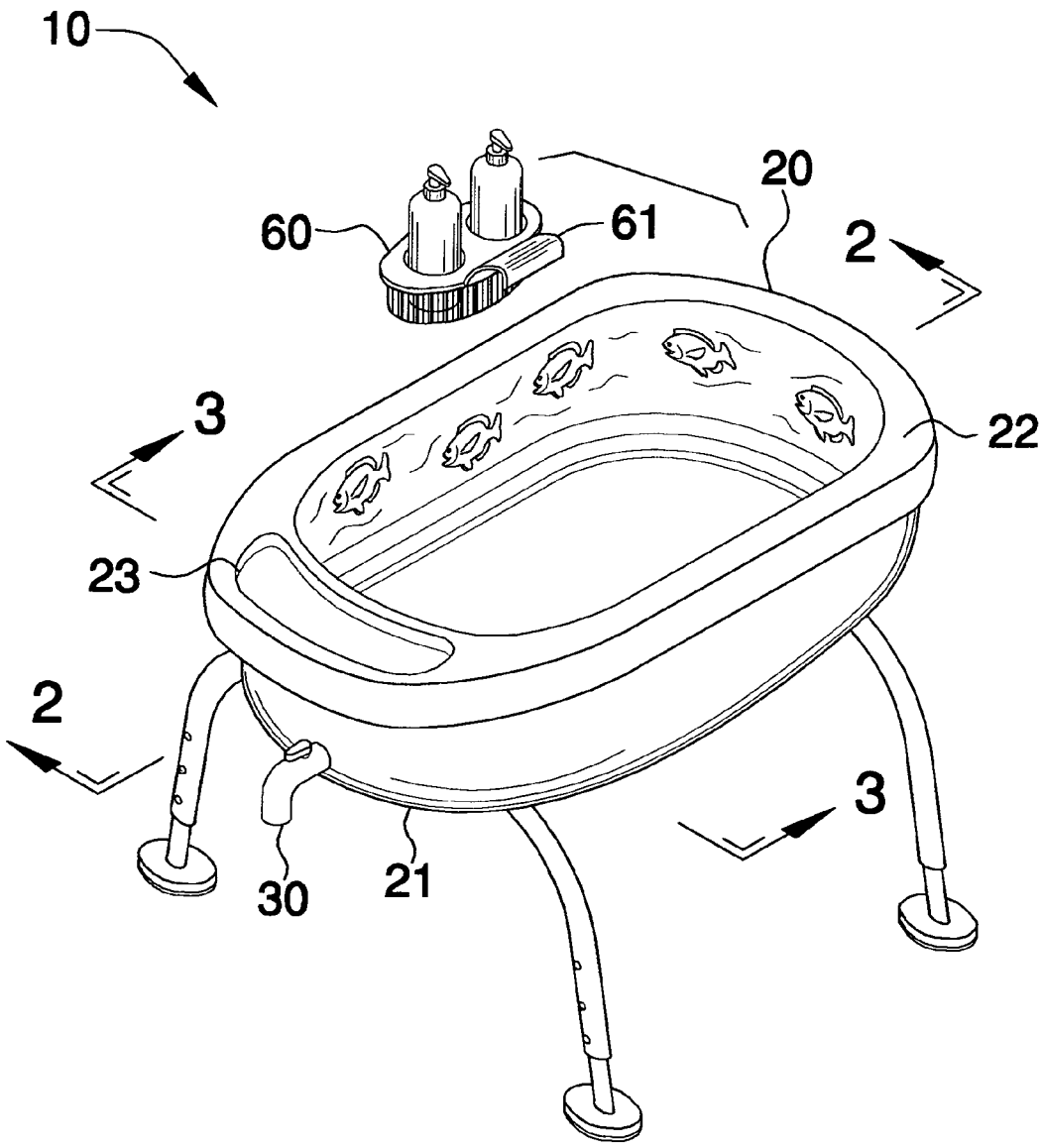
FIG. 1 is a perspective view showing a collapsible infant tub, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a collapsible infant tub. It should be understood that the apparatus 10 may be adjusted to several different heights to make bathing an infant easier for the caretaker and safer for the child.

Referring initially to FIG. 1, the apparatus 10 includes a tub section 20 having a centrally disposed longitudinal axis and defining a cavity for supporting an infant therein during operating conditions. The tub section 20 includes a substantially smooth bottom surface 21 and an outer edge portion 22 integral therewith and extending upwardly therefrom about a perimeter of the bottom surface 21. The outer edge portion 22 of the tub section 20 further has a recessed portion 23 formed therein and subjacent to the drain spout 30. Such a recessed portion 23 supports bathing accessories therein such as washcloths, soap bars and the like, for example.

Figure 2:
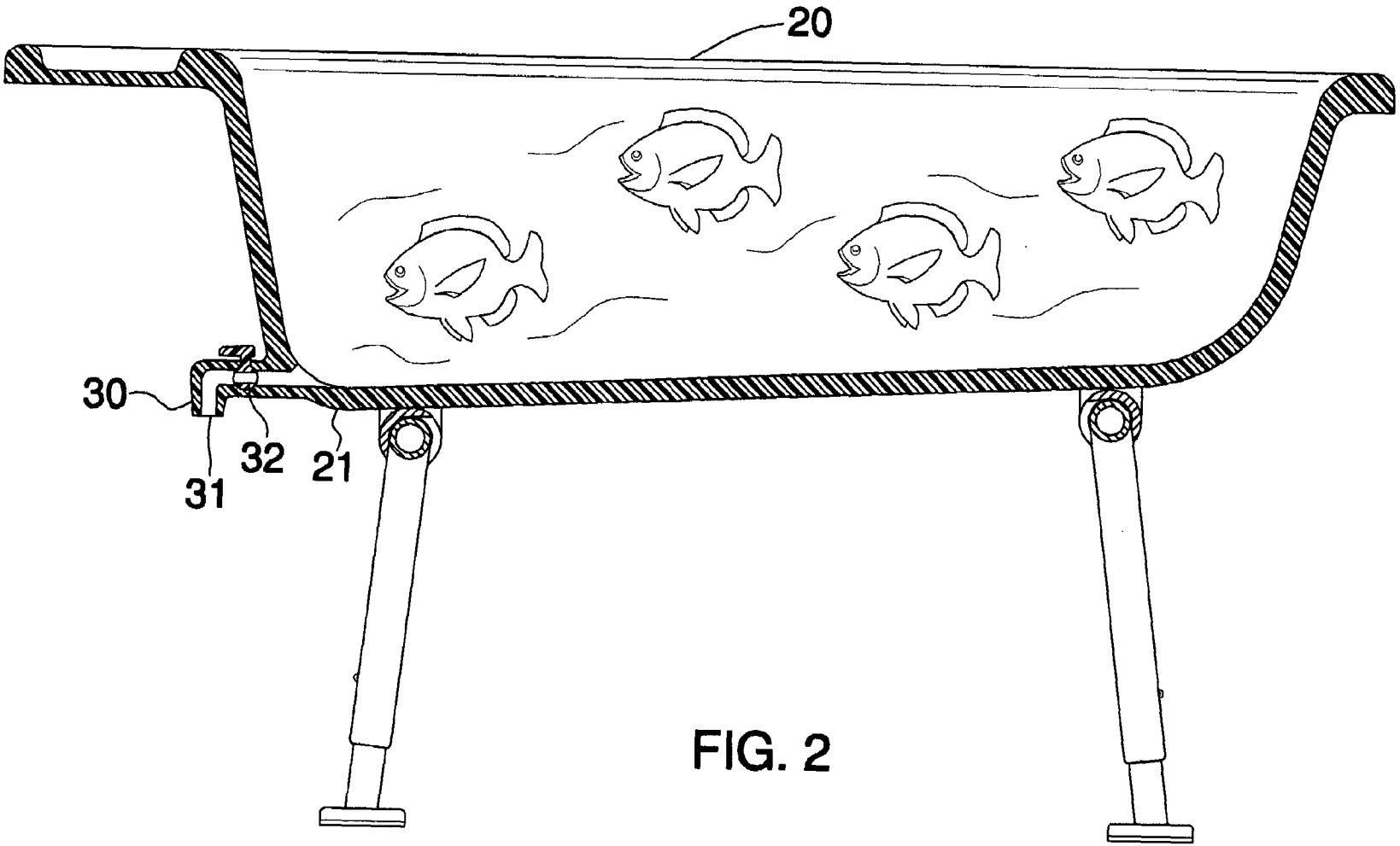
FIG. 2 is a cross-sectional view of the present invention shown in FIG. 1, taken along line 2—2.

Referring to FIG. 2, the tub section 20 further includes a drain spout 30 in fluid communication with the cavity and extending outwardly and downwardly from the bottom surface 21. The drain spout 30 includes a mechanism 31 for dispensing and retaining water within the cavity respectively. The dispensing and retaining mechanism 31 preferably includes a ball valve 32 operably positioned within the drain spout 30 that is selectively movable between open and closed positions.

Figure 3:
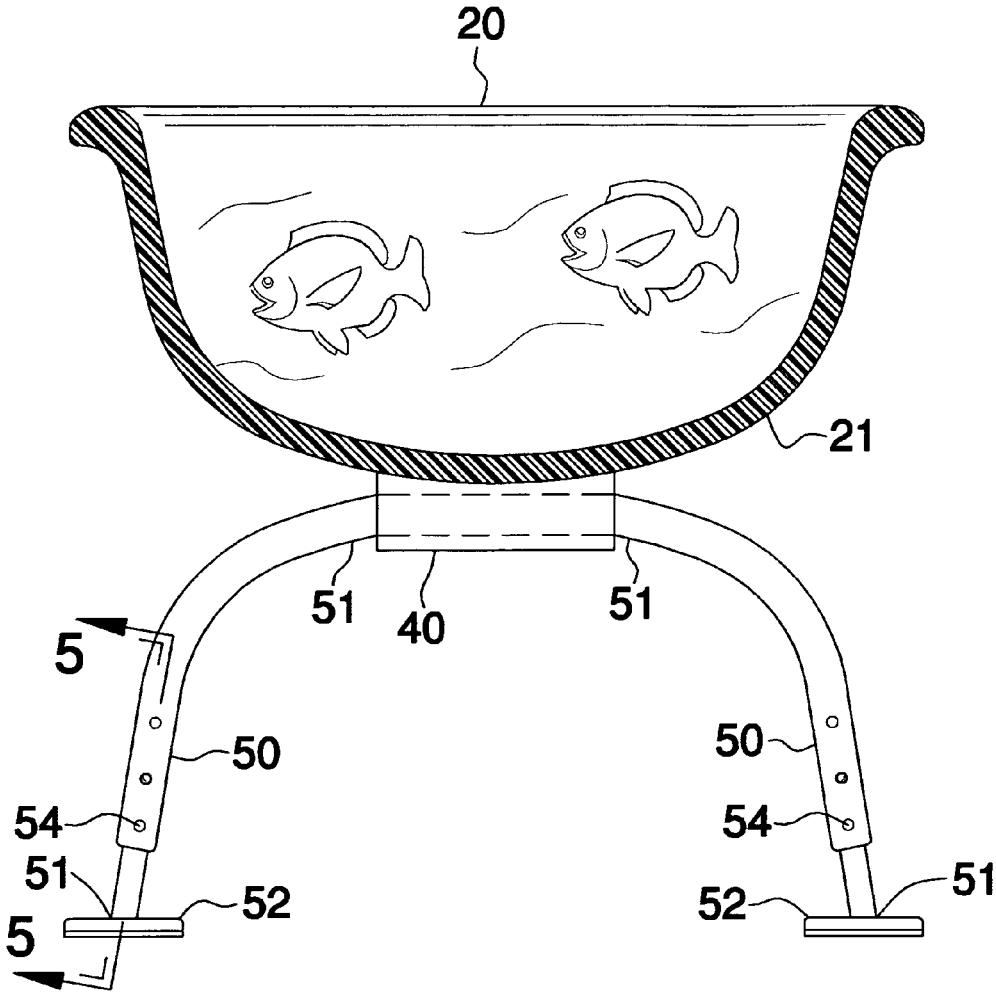
FIG. 3 is a cross-sectional view of the present invention shown in FIG. 1, taken along line 3—3.

Referring to FIG. 3, the tub section 20 further includes a plurality of hollow support members 40 traversing the axis that are secured to the bottom surface 21 and extending downwardly therefrom. Advantageously, the tub section 20 has a plurality of leg members 50 that are positioned through the plurality of support members 40 respectively for maintaining the tub section 20 at a substantially stable position during operating conditions. Such a plurality of leg members 50 have opposed end portions 51 engageable with a ground surface and are substantially equally offset from the axis. The opposed end portions 51 have substantially planar bottom surfaces 52, which may be formed from rubber material for assisting to maintain the apparatus 10 at a substantially stable position, as well-known to a person of ordinary skill in the art.

Figure 4:
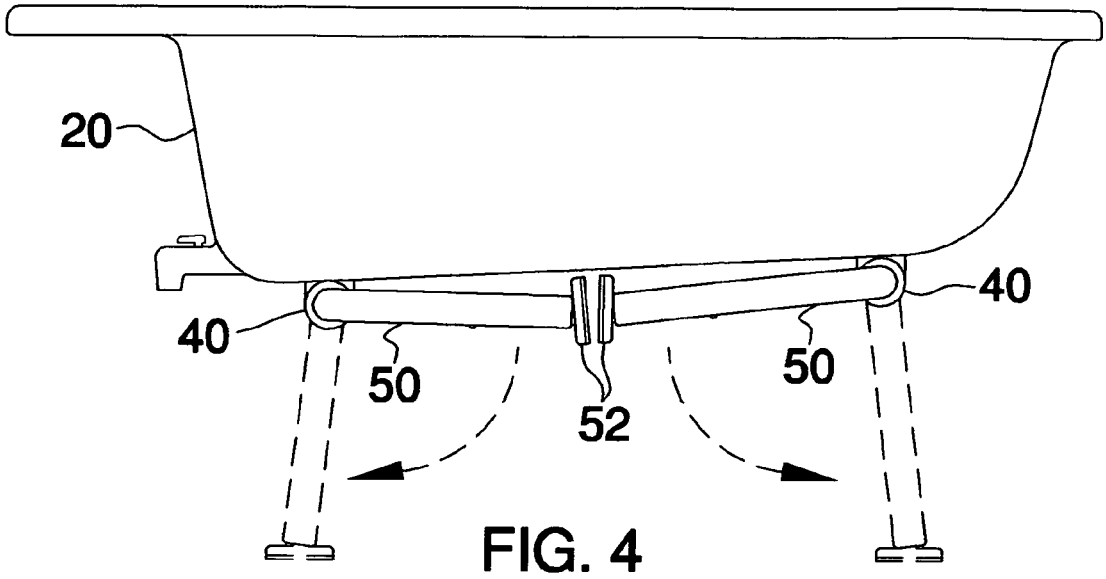
FIG. 4 is a side elevational view of the present invention showing the plurality of leg members being pivotal between folded and extended positions.
Figure 5:
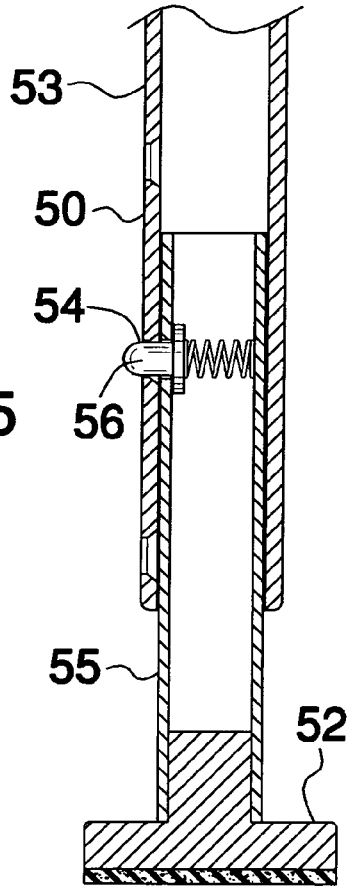
FIG. 5 is a cross-sectional view of FIG. 1 showing the telescopic portions of a leg member.

Referring to FIGS. 4 and 5, the plurality of leg members 50 are pivotal about the plurality of support members 40, between folded and extended positions respectively. Each of the leg members 50 includes a plurality of female portions 53 having a plurality of apertures 54 formed therein and spaced along a generally vertical plane. The plurality of leg members 50 also include a plurality of male portions 55 telescopically engageable with the plurality of female portions 53. Such a plurality of male portions 55 each include a spring-operable pin 56 extending outwardly therefrom that is removably positionable into select ones of the plurality of apertures 54 so that a height of the apparatus 10 may be advantageously adjusted as desired by a user.

Referring back to FIG. 1, the present invention further includes a portable tray 60 having a lip portion 61 integral therewith for removably engaging the outer edge portion 22 of the tub section 20. Such a portable tray 60 may be used for supporting bathing accessories therein and is selectively slidable along a perimeter of the tub section 20. The portable tray 60 allows a parent or caregiver to have everything they need during bathing within their reach.

Often parents are so uncomfortable using a bathtub that they use a countertop. This inevitably leads to a mess and more work for the parent who has to clean up. The present invention allows parents and other caregivers to comfortably bathe an infant without having to stoop over a bathtub or clean up a mess. It gives older siblings and other family members who might have aches and pains an opportunity to help out and have fun as a family.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for bathing infants therein, said apparatus comprising:

a tub section having a centrally disposed longitudinal axis and defining a cavity for supporting an infant therein during operating conditions, said tub section comprising a substantially smooth bottom surface and an outer edge portion integral therewith and extending upwardly therefrom about a perimeter of said bottom surface, a drain spout in fluid communication with said cavity and extending outwardly and downwardly from said bottom surface, said drain spout comprising means for dispensing and retaining water within said cavity respectively, and a plurality of hollow support members traversing the axis and being secured to said bottom surface and extending downwardly therefrom; and a plurality of leg members positioned through said plurality of support members respectively and for maintaining said tub section at a substantially stable position during operating conditions, said plurality of leg members having opposed end portions engageable with a ground surface and being substantially equally offset from the axis, said plurality of leg members being pivotal about said plurality of support members and between folded and extended positions respectively.

2. The apparatus of claim 1, wherein each said plurality of leg members comprises:

a plurality of female portions having a plurality of apertures formed therein and spaced along a generally vertical plane; and a plurality of male portions telescopically engageable with said plurality of female portions, said plurality of male portions each including a spring-operable pin extending outwardly therefrom and being removably positionable into select ones of said plurality of apertures so that a height of said apparatus can be adjusted as desired by a user.

3. The apparatus of claim 1, wherein said opposed end portions have substantially planar bottom surfaces formed from rubber material and for assisting to maintain said apparatus at a substantially stable position.

4. The apparatus of claim 1, wherein said dispensing and retaining means comprises: a ball valve operably positioned within said drain spout and being selectively movable between open and closed positions.

5. The apparatus of claim 1, wherein said outer edge portion further has a recessed portion formed therein and subjacent to said drain spout, said recessed portion for supporting bathing accessories therein.

6. The apparatus of claim 1, further comprising: a portable tray including a lip portion integral therewith and for removably engaging said outer edge portion of said tub section, said portable tray for supporting bathing accessories therein and being selectively slidable along a perimeter of said tub section.

7. An apparatus for bathing infants therein, said apparatus comprising:

a tub section having a centrally disposed longitudinal axis and defining a cavity for supporting an infant therein during operating conditions, said tub section comprising a substantially smooth bottom surface and an outer edge portion integral therewith and extending upwardly therefrom about a perimeter of said bottom surface, a drain spout in fluid communication with said cavity and extending outwardly and downwardly from said bottom surface, said drain spout comprising means for dispensing and retaining water within said cavity respectively, and a plurality of hollow support members traversing the axis and being secured to said bottom surface and extending downwardly therefrom; and a plurality of leg members positioned through said plurality of support members respectively and for maintaining said tub section at a substantially stable position during operating conditions, said plurality of leg members having opposed end portions engageable with a ground surface and being substantially equally offset from the axis, said plurality of leg members being pivotal about said plurality of support members and between folded and extended positions respectively; each said plurality of leg members comprising a plurality of female portions having a plurality of apertures formed therein and spaced along a generally vertical plane, and a plurality of male portions telescopically engageable with said plurality of female portions, said plurality of male portions each including a spring-operable pin extending outwardly therefrom and being removably positionable into select ones of said plurality of apertures so that a height of said apparatus can be adjusted as desired by a user.

8. The apparatus of claim 7, wherein said opposed end portions have substantially planar bottom surfaces formed from rubber material and for assisting to maintain said apparatus at a substantially stable position.

9. The apparatus of claim 7, wherein said dispensing and retaining means comprises: a ball valve operably positioned within said drain spout and being selectively movable between open and closed positions.

10. The apparatus of claim 7, wherein said outer edge portion further has a recessed portion formed therein and subjacent to said drain spout, said recessed portion for supporting bathing accessories therein.

11. The apparatus of claim 7, further comprising: a portable tray including a lip portion integral therewith and for removably engaging said outer edge portion of said tub section, said portable tray for supporting bathing accessories therein and being selectively slidable along a perimeter of said tub section.

12. An apparatus for bathing infants therein, said apparatus comprising:

a tub section having a centrally disposed longitudinal axis and defining a cavity for supporting an infant therein during operating conditions, said tub section comprising a substantially smooth bottom surface and an outer edge portion integral therewith and extending upwardly therefrom about a perimeter of said bottom surface, a drain spout in fluid communication with said cavity and extending outwardly and downwardly from said bottom surface, said drain spout comprising means for dispensing and retaining water within said cavity respectively, and a plurality of hollow support members traversing the axis and being secured to said bottom surface and extending downwardly therefrom; and a plurality of leg members positioned through said plurality of support members respectively and for maintaining said tub section at a substantially stable position during operating conditions, said plurality of leg members having opposed end portions engageable with a ground surface and being substantially equally offset from the axis, said plurality of leg members being pivotal about said plurality of support members and between folded and extended positions respectively; each said plurality of leg members comprising a plurality of female portions having a plurality of apertures formed therein and spaced along a generally vertical plane, and a plurality of male portions telescopically engageable with said plurality of female portions, said plurality of male portions each including a spring-operable pin extending outwardly therefrom and being removably positionable into select ones of said plurality of apertures so that a height of said apparatus can be adjusted as desired by a user;

said opposed end portions having substantially planar bottom surfaces formed from rubber material and for assisting to maintain said apparatus at a substantially stable position.

13. The apparatus of claim 12, wherein said dispensing and retaining means comprises: a ball valve operably positioned within said drain spout and being selectively movable between open and closed positions.

14. The apparatus of claim 12, wherein said outer edge portion further has a recessed portion formed therein and subjacent to said drain spout, said recessed portion for supporting bathing accessories therein.

15. The apparatus of claim 12, further comprising: a portable tray including a lip portion integral therewith and for removably engaging said outer edge portion of said tub section, said portable tray for supporting bathing accessories therein and being selectively slidable along a perimeter of said tub section.

* * * * *